US008666025B2

(12) United States Patent
Klausz

(10) Patent No.: US 8,666,025 B2
(45) Date of Patent: Mar. 4, 2014

(54) BACK FOCUSED ANTI-SCATTER GRID

(75) Inventor: Remy Andre Klausz, Neuilly sur Seine (FR)

(73) Assignee: General Electric Company, Schenectady, NY (US)

( * ) Notice: Subject to any disclaimer, the term of this patent is extended or adjusted under 35 U.S.C. 154(b) by 82 days.

(21) Appl. No.: 12/950,618

(22) Filed: Nov. 19, 2010

(65) Prior Publication Data

US 2011/0129070 A1 Jun. 2, 2011

(30) Foreign Application Priority Data

Nov. 27, 2009 (FR) ..... 09 58440

(51) Int. Cl.
*G21K 1/00* (2006.01)

(52) U.S. Cl.
USPC ..... 378/154; 378/147

(58) Field of Classification Search
USPC ..... 378/154, 147
See application file for complete search history.

(56) References Cited

U.S. PATENT DOCUMENTS 2,605,427 A * 7/1952 Delhumeau ..... 378/154
5,418,833 A * 5/1995 Logan ..... 378/154
5,557,650 A 9/1996 Guida et al.
7,356,126 B2 4/2008 Bacher et al.
2009/0147923 A1* 6/2009 Kammel et al. ..... 378/154
2009/0323899 A1* 12/2009 Dorscheid et al. ..... 378/154

FOREIGN PATENT DOCUMENTS

EP 0731472 A1 9/1996
GB 1493267 11/2010
WO 2007/034352 3/2007

OTHER PUBLICATIONS

Rezentes, P. et al., "Mammography Grid Performance", Jan. 1999 Radiology, 210, pp. 227-232.

* cited by examiner

*Primary Examiner* — Hoon Song

(74) *Attorney, Agent, or Firm* — Global Patent Opertation; Marc A. Vivenzio

(57) ABSTRACT

An anti-scatter grid for an x-ray imaging system. The grid has substrate having a first face and a second face. The substrate has a plurality of grooves opening onto the first face of the substrate and not opening onto the second face. The substrate has high X-ray absorption properties. Each groove has an orientation such that the planes of all the grooves are convergent and intersect along a line situated on the side of the second face where the grooves do not open.

12 Claims, 2 Drawing Sheets

BACK FOCUSED ANTI-SCATTER GRID

BACKGROUND OF THE INVENTION

1. Field of the Invention

The field of the invention relates to anti-scatter grids used in medical imaging by means of radiation.

2. Description of the Prior Art

Anti-scatter grids are widely used in medical imaging to improve image contrast quality.

FIG. 1 illustrates a conventional medical imaging system.

Such a system comprises a radiation source 1, for example of the X-ray type, which projects a conical beam for illuminating an object 2, such as for example a part or an organ of a patient to be examined before reaching an image receptor 3 comprising a detector array.

An anti-scatter grid 4 is inserted between the source 1 and the image receptor 3 so as to attenuate the radiation not coming directly from the source 1, particularly scattered radiation.

Conventionally, an anti-scatter grid comprises an alternation of thin plane strips consisting of a highly X-ray absorbent material, such as lead for example, separated by spacer bands that are very transparent to said radiation. The document U.S. Pat. No. 7,356,126 describes such a grid.

The grid may further be focussed according to the terminology defined by the standard IEC 60627 relating to X-ray diagnostic imaging devices.

Focussed grids make it possible to improve effective ray transmission.

FIG. 2 illustrates the general principle of a focussed grid.

In use, the strips 20 of material having high X-ray absorption properties (radio-opaque strips) are distributed and oriented towards the focal point formed by the radiation source. All the planes of the strips intersect along the same line D. The grid is used by positioning the focal point F of the X-ray source 1 substantially on the line D.

One problem with the grids as described above is that the regularity thereof is not sufficient, particularly in applications where the grid is fixed in relation to the image receptor. Furthermore, these grids are difficult to produce.

In order to remedy this production problem, a process for producing an anti-scatter grid has been developed.

The document U.S. Pat. No. 5,557,650 describes such a process. Such a process implements a substrate having low X-ray absorption properties wherein grooves are formed. Once the grooves have been formed, said grooves are filled with a material 31 having high X-ray absorption properties.

FIG. 3 illustrates a cross-section of a grid obtained with this process. The grid obtained comprises a substrate S comprising a plurality of grooves 30 in the thickness of the substrate. In this grid, the grooves 30 are filled with a material 31 having X-ray absorption properties. The grooves only open onto one face of the substrate. Furthermore, the orientation 32 of the grooves is such that the grid is focussed on the focal point of the X-ray source.

Such a grid is arranged in an imaging system such that the face 33 where the grooves open is on the side of the X-ray source. The other face 34 is arranged on the side of the image receptor.

One problem is that, in use, it has been observed that the substrate produced diffuse radiation $S_G$ which was not stopped by the strips obtained by filling the groove such that the primary radiation $S_p$ passing through the substrate is degraded by the radiation $S_G$ scattered by the substrate. In use, the performances of such a grid are limited.

SUMMARY OF THE INVENTION

Embodiments of the invention propose a solution which does not involve the abovementioned drawbacks.

According to a first aspect, the invention relates to an anti-scatter grid comprising a substrate having a first face and a second face, the substrate comprising a plurality of grooves opening onto the first face of the substrate and not opening onto the second face, the substrate having low X-ray absorption properties, the grooves being filled with a material having high X-ray absorption properties and each having an orientation such that the planes of all the grooves are convergent and intersect along a line situated on the site of the second face where the grooves do not open.

The grid according to the first aspect of the invention is therefore focused on the side where the grooves do not open.

In this way, in use, the face where the grooves do not open will be the side of the X-ray source.

Other aspects of the grid according to the first aspect of the invention are as follows: the substrate is a material selected in the group consisting of polyetherimides, polyimides and polycarbonates; the substrate consists of carbon, preferably graphite; the absorbent material comprises a metallic lead alloy; it comprises a protective layer on at least one face, the protective layer comprising a material having the property of attenuating X-rays slightly; the grid ratio is between 2 and 16, wherein the number of grooves per centimeter is between 30 and 300.

According to a second aspect, the invention relates to a medical imaging system comprising a radiation source, an image receptor receiving radiation emitted by the source via an object or a patient to undergo imaging, and an anti-scatter grid according to the first aspect of the invention arranged such that the second face where the grooves do not open is arranged on the side of the radiation source and the first face where the groove open rests on the image receptor, or a short distance from the image receptor.

According to a third aspect, the invention relates to a process for producing an anti-scatter grid comprising the following steps: forming in a substrate having low X-ray absorption properties, by means of a cutting tool, a plurality of grooves, the tool approaching the substrate according to a predetermined angle, such that the approach directions of the tool have an intersection point opposite the groove; heating the material having X-ray absorption properties to the melting point thereof; and filling the grooves formed in the substrate with a material having X-ray absorption properties.

According to a fourth aspect, the invention relates to a medical imaging process wherein images are acquired by means of a medical imaging system according to the third aspect of the invention.

According to a fifth aspect, the invention relates to the use of a process according to the fourth aspect for mammography or tomosynthesis image acquisition.

BRIEF DESCRIPTION OF THE DRAWINGS

Other features and advantages of the invention will emerge from the following description which is purely illustrative and not limitative and should be read with reference to the appended figures wherein.

DETAILED DESCRIPTION OF THE INVENTION

Figure 4:
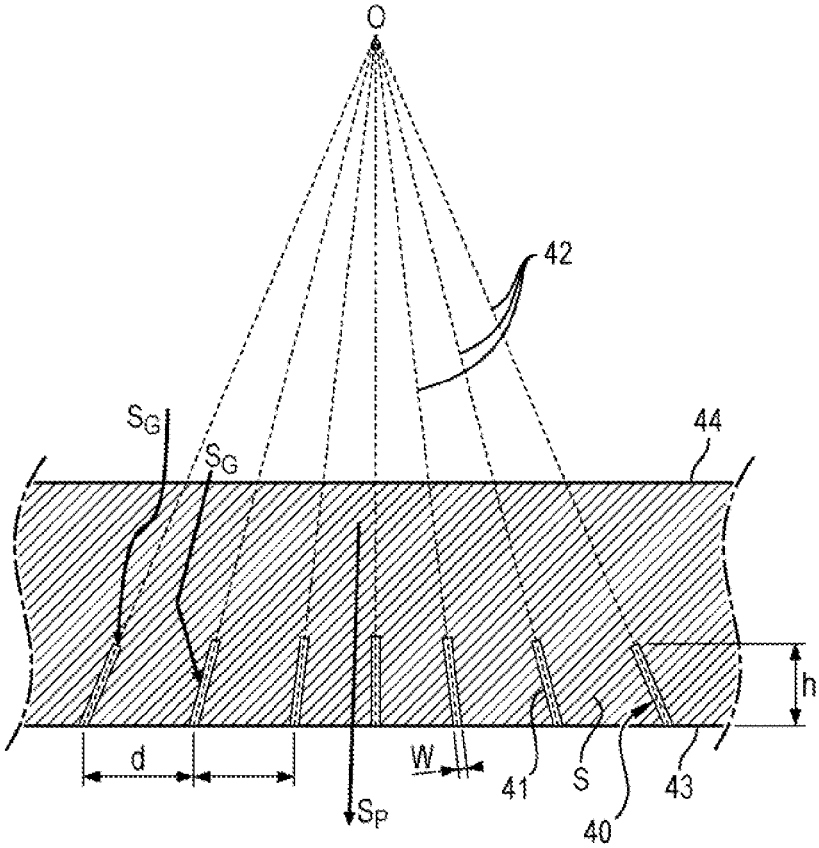
FIG. 4 illustrates a cross-section view of an anti-scatter grid according to the invention.

FIG. 4 illustrates a cross-section view of a focussed anti-scatter grid.

Such a grid comprises a substrate S having a first face 44 and a second face 43.

The substrate S comprises a plurality of grooves 40 opening onto the first face 44 of the substrate S and not opening onto the second face 43.

The substrate S has low X-ray absorption properties and the grooves 40 are filled with an absorbent material 41 having X-ray absorption properties.

The grooves 40 each have an orientation. The orientation is such that the planes 42 of all grooves 40 are convergent and intersect along a line D situated on the side of the second face 44 where the grooves 40 do not open.

Such a grid is produced according to the process described in the document U.S. Pat. No. 7,356,126.

The main steps of this process consist of forming in a substrate, having low X-ray absorption properties, a plurality of grooves. The grooves are for example formed by means of a cutting tool, such as a rotary disk machines (diamond for example). It is noted that these machine are, for example, used for cutting wafers of semiconductor material and have very high precision digital control.

The cutting tool is particularly controlled to approach the substrate according to a predetermined angle, such that the approach directions of the tool have an intersection point opposite the strip.

The grooves formed are then filled with a previously melted material having high X-ray absorption properties.

For more details on the process used, reference may be made to the document U.S. Pat. No. 7,356,126.

The substrate S is a material selected in the group consisting of polyetherimides, polyimides and polycarbonates. It may also consist of carbon and preferably graphite.

The absorbent material comprises a metallic lead alloy.

Furthermore, the grid may comprise protective means on at least one face 43, 44. Such protective means consist for example of a coat of varnish. It may also consist of a plate mounted and glued on at least one face 43, 44. In the latter case, the mounted plate helps increase the rigidity of the grid. It is noted that, preferably, the protective means are arranged on the face 43 where the grooves open, in order to protect same.

Such a protective layer comprises a material having low X-ray absorption properties.

Figure 1:
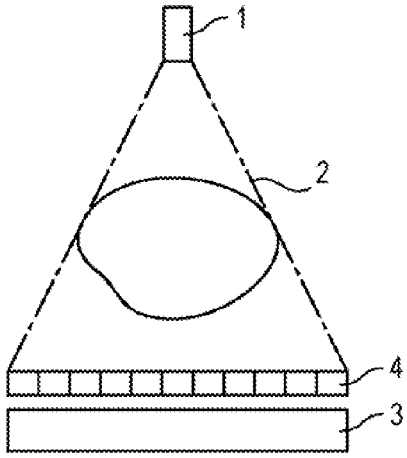
FIG. 1 illustrates a conventional medical imaging system.
Figure 2:
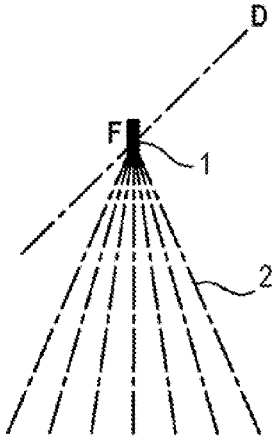
FIG. 2 illustrates the general principle of a focused grid.
Figure 2:
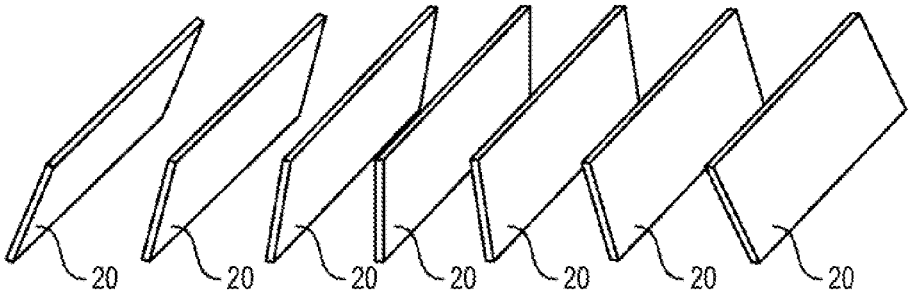
Figure 3:
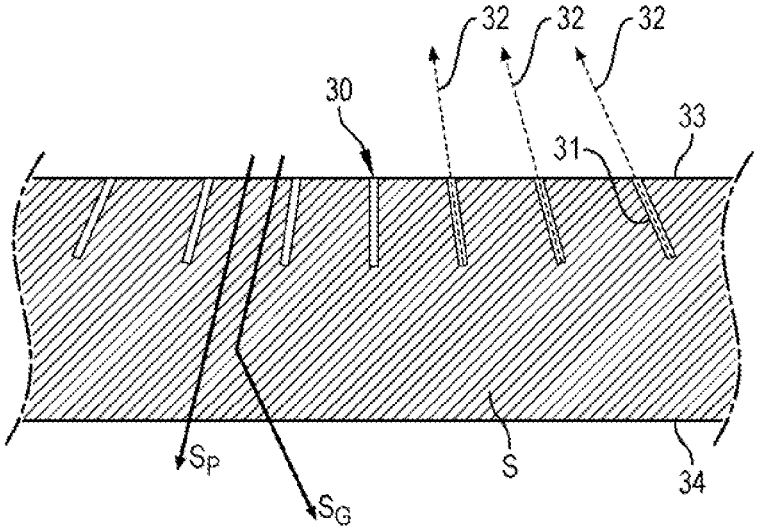
FIG. 3 illustrates a cross-section of a grid obtained using a conventional process.

The grid is used in a medical imaging system as illustrated, and already described, in FIG. 1.

As already described above, the grid should be arranged in the medical imaging system according to the focal direction thereof.

Therefore, the focussed grid has grooves with an orientation such that the planes 42 of each groove 40 are convergent and intersect along a line D situated on the side of the second face 44 where the grooves 40 do not open, the grid must be arranged such that the second face 44 where the grooves do not open is arranged on the side of the X-ray source.

The first face 43, where the grooves open, rests on the image receptor 3, or may be a short distance from the image receptor.

With such an arrangement, the radiation scattered by the imaging system and by the substrate is attenuated by the grooves.

Understandably, the path of the rays is such that said rays first pass through the substrate and then via the zone when the grooves made of material having X-ray absorption properties and the remainder of the substrate situated between the grooves formed are present in alternation.

An anti-scatter grid is defined by a grid ratio which is the ratio between the height h of the strips and the distance d between two strips.

For use in a medical imaging system, such a grid ratio is between 2 and 16.

A further grid parameter is the number of strips per centimeter. This number is typically between 30 and 80 strips per centimeter.

Furthermore, the strips have a width w between 15 and 50 μm and it is possible to have up to 300 strips per centimeter.

The invention claimed is:

1. An anti-scatter grid, comprising:

a substrate comprising a first face, and a second face, the first face comprising a plurality of grooves opening onto the first face of the substrate and not opening onto the second face of the substrate, wherein the second face does not comprise grooves, wherein the first face is arranged opposite the second face, the second face facing a radiation source, and the first face facing an image receptor configured to receive radiation emitted by the radiation source, wherein the substrate has low X-ray absorption properties, and wherein the grooves are filled with a material having high X-ray absorption properties and each having an orientation such that the planes of all the grooves are convergent and intersect along a line situated on the side of the second face where the grooves do not open.

2. An anti-scatter grid according to claim 1, wherein the substrate is a material selected from the group consisting of polyetherimides, polyimides and polycarbonates.

3. An anti-scatter grid according to claim 1, wherein the substrate consists of carbon, preferably in the form of graphite.

4. An anti-scatter grid according to claim 1, wherein the absorbent material comprises a metallic lead alloy.

5. An anti-scatter grid according to claim 1, further comprising:

a protective layer on at least one face, the protective layer comprising a material having the property of attenuating X-rays slightly.

6. An anti-scatter grid according to claim 1, wherein the grid ratio is between 2 and 16, and wherein the number of grooves per centimeter is between 30 and 300.

7. A medical imaging system, comprising:

a radiation source;

an image receptor configured to receive radiation emitted by the source via an object of a patient to undergo imaging; and an anti-scatter grid comprising a substrate comprising a first face, and a second face, the first face comprising a plurality of grooves opening onto the first face of the substrate and not opening onto the second face of the substrate, wherein the second face does not comprise grooves, wherein the first face is arranged opposite the second face, wherein the substrate has low X-ray absorption properties, wherein the grooves are filled with a material having high X-ray absorption properties and each having an orientation such that the planes of all the grooves are convergent and intersect along a line situated on the side of the second face where the grooves do not open, and wherein the medical imaging system is arranged such that the second face where the grooves do not open is positioned on the side of the radiation source and the first face where the groove open is positioned on the image receptor, or a predetermined distance from the image receptor.

8. The medical imaging system according to claim 7, wherein the substrate is a material selected from the group consisting of polyetherimides, polyimides and polycarbonates.

9. The medical imaging system according to claim 7, wherein the substrate consists of carbon, preferably in the form of graphite.

10. The medical imaging system according to claim 7, wherein the absorbent material comprises a metallic lead alloy.

11. The medical imaging system according to claim 7, wherein the anti-scatter grid further comprises a protective layer on at least one face, the protective layer comprising a material having the property of attenuating X-rays slightly.

12. The medical imaging system according to claim 7, wherein the grid ratio of the anti-scatter grid is between 2 and 16, and wherein the number of grooves per centimeter is between 30 and 300.

* * * * *